US007486918B2

(12) United States Patent
Kojima

(10) Patent No.: US 7,486,918 B2
(45) Date of Patent: Feb. 3, 2009

(54) IMAGE FORMING APPARATUS WITH A BELT CURLING CORRECTION FEATURE

(75) Inventor: Etsuji Kojima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 107 days.

(21) Appl. No.: 11/562,540

(22) Filed: Nov. 22, 2006

(65) Prior Publication Data

US 2007/0127954 A1 Jun. 7, 2007

(30) Foreign Application Priority Data

Nov. 30, 2005 (JP) ..... 2005-346307

(51) Int. Cl.
*G03G 15/16* (2006.01)

(52) U.S. Cl. ..... 399/302; 399/303

(58) Field of Classification Search ..... 399/302, 399/303, 308, 312

See application file for complete search history.

(56) References Cited

U.S. PATENT DOCUMENTS 6,984,956 B2 * 1/2006 Kang et al. ..... 318/685

FOREIGN PATENT DOCUMENTS

| | | |
|---|---|---|
| JP | H 09-110253 | 4/1997 |
| JP | 2000-112261 | 4/2000 |
| JP | 2002-006585 | 1/2002 |
| JP | 2003-173090 | 6/2003 |

* cited by examiner

*Primary Examiner*—Quana M Grainger
(74) *Attorney, Agent, or Firm*—Fitzpatrick, Cella, Harper & Scinto

(57) ABSTRACT

There is provided an image forming apparatus including a belt which conveys images, first rollers which support the belt and a second roller which supports the aforementioned belt at its surface opposite from the surface supported by the aforementioned first rollers, wherein the image forming apparatus rotates the aforementioned belt at a first speed and rotates the aforementioned belt at a second speed smaller than the aforementioned first speed or stops the aforementioned belt when the portions of the aforementioned belt which have been supported by the aforementioned first rollers at the time of stoppage of the aforementioned belt are supported by the aforementioned second roller, prior to image formation after the stoppage of the aforementioned belt.

15 Claims, 7 Drawing Sheets

FIG. 6

| The belt stopping time period (hours) | The curling-tendency correcting time period (seconds) |
|---|---|
| ~ 2.5 hours | 0 |
| 2.5 ~ 5 | 30 |
| 5 ~ 10 | 90 |
| 10 ~ 15 | 120 |
| 15 ~ | 180 |

*FIG. 7*

| | The state of the curling tendency for the rotating time period | | | | | |
|---|---|---|---|---|---|---|
| The belt speed | 30 sec. | 60 sec. | 90 sec. | 120 sec. | 210 sec. | 300 sec. |
| A (100mm/sec.) only | × | × | × | × | × | ○ |
| A (100mm/sec.)-B(20mm/sec.) | × | ○ | ○ | ○ | ○ | ○ |
| A (100mm/sec.)-B(10mm/sec.) | ○ | ○ | ○ | ○ | ○ | ○ |

IMAGE FORMING APPARATUS WITH A BELT CURLING CORRECTION FEATURE

BACKGROUND OF THE INVENTION

1. Field of the Invention

The present invention relates to an image forming apparatus which records, onto recording mediums, images formed with image forming means and also forms images by rotating a belt being supported by rollers. More particularly, the present invention relates to an image forming apparatus including a means for correcting the curling tendency of the belt.

2. Description of the Related Art

As image forming apparatuses such as copying machines and printers, electrophotographic type image forming apparatuses have been widely used as image forming means. In the present day, apparatuses capable of forming color images have been used as such copying machines.

An electrophotographic type color-image forming apparatus includes plural image forming stations for forming images in respective colors of yellow, magenta, cyan and black which are arranged in parallel and superimposes images formed in the respective image forming stations to form a color image. As the configuration for superimposing the images having the respective colors, an intermediate transfer belt which is an endless belt is placed such that it is faced to the plural image forming stations placed in parallel, and images formed in the respective image forming stations are successively primarily transferred to the intermediate transfer belt to form a color image. This color image is secondarily transferred to a recording medium at a secondary transfer portion and, then, the color image is output.

Also, in addition to the aforementioned intermediate transfer system, there is a system for conveying a recording medium through an endless belt facing to respective image forming stations and successively transferring color images formed in the respective image forming stations to the recording medium such that they are superimposed thereon to form a color image.

As described above, a color-image forming apparatus forms images by rotating an endless belt, wherein the endless belt is wound around and supported by plural rollers. However, bending stresses are constantly generated in the endless belt wound around and supported by the tension rollers, at its portions which come into contact with the tension rollers.

Usually, such bending stresses and physical changes are dispersed over the entire belt during movement of the belt, which prevents the occurrence of significant malfunctions. However, when the belt is temporarily brought into a standby state, such bending stresses and physical changes are generated concentratively at the portions of the belt which come into contact with the rollers and the heated portion of the belt. This may cause permanent sets in the belt, thereby causing image degradations such as color shifts, color heterogeneity and the like.

Also, it is possible to employ a method which idly rotates the intermediate transfer belt for a predetermined time period after the start of operation in order to disperse bending stresses and physical changes over the entire belt. However, if the standby time period becomes longer, this will make it impossible to form images efficiently.

Therefore, there has been disclosed a configuration for releasing or reducing the pressures exerted on a belt from tension rollers at non-operation states of an apparatus, in order to prevent the aforementioned belt from exhibiting a curling tendency (Japanese Patent Application Laid-open No. 2003-173090).

However, if the apparatus is configured to release or reduce the pressures exerted on the belt from the tension rollers at non-operation states of the apparatus as described in the aforementioned Japanese Patent Application Laid-open No. 2003-173090, this will cause the problem of increases of the complicacy and the size of the apparatus.

SUMMARY OF THE INVENTION

It is an object of the present invention to correct deformations of a belt which are generated at its portions supported by first rollers at the time of stoppage of the belt, with a simple configuration.

Further, it is another object to provide an image forming apparatus including:

a belt which conveys images;

a first roller which supports said belt;

a second roller which supports said belt at its surface opposite from the surface supported by said first roller; and a speed changing means for rotating said belt at a first speed and for rotating said belt at a second speed smaller than said first speed or stopping said belt when the portion of said belt which has been supported by said first roller at the time of stoppage of said belt is supported by said second roller, prior to image formation after the stoppage of the belt.

BRIEF DESCRIPTION OF THE DRAWINGS

FIG. 6 is a view illustrating the relationship between the standby time period and the time period required for correcting the curling tendency.

FIG. 7 is an explanation view of driving and controlling for changing the curling-tendency correcting time period according to the standby time period.

DESCRIPTION OF THE EMBODIMENTS

Next, with reference to the drawings, there will be described an image forming apparatus according to an embodiment of the present invention.

First Embodiment

Figure 1:
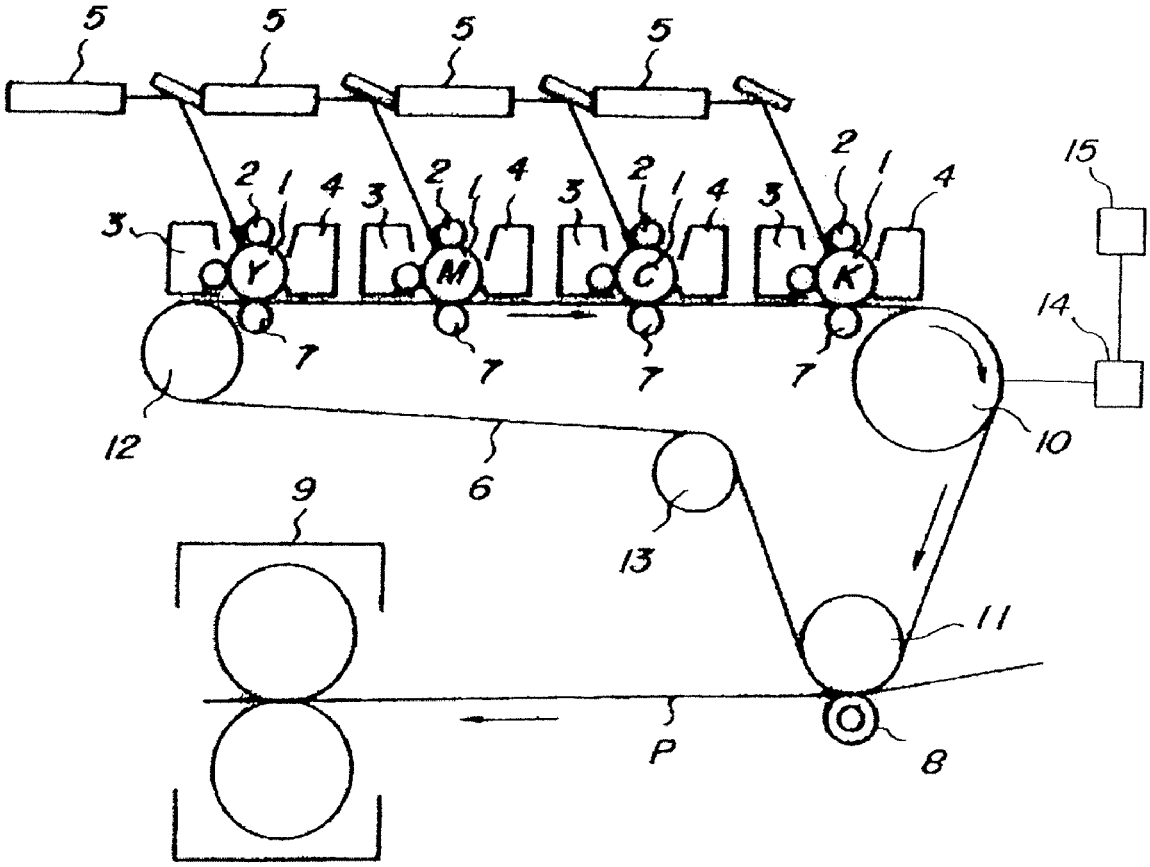
FIG. 1 is a schematic explanation view of the entirety of an image forming apparatus.
Figure 2:
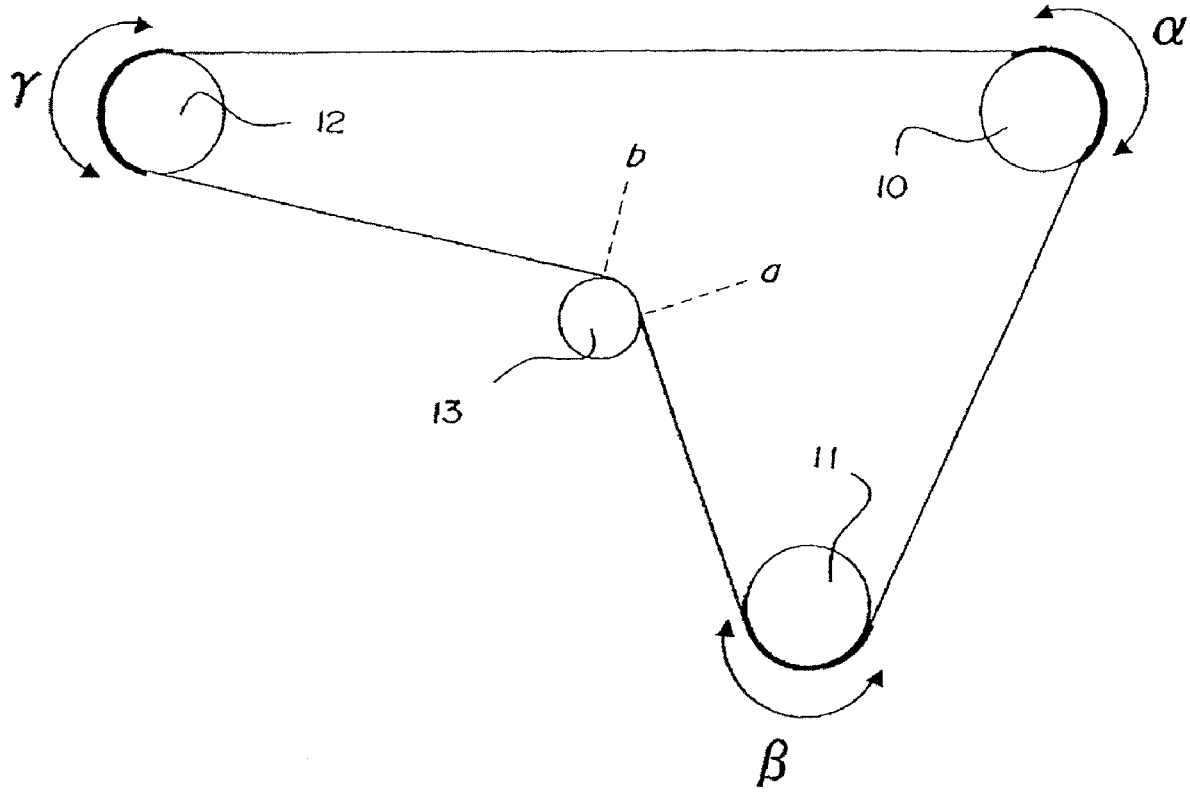
FIG. 2 is an explanation view of winding and stringing of an endless belt.
Figure 3:
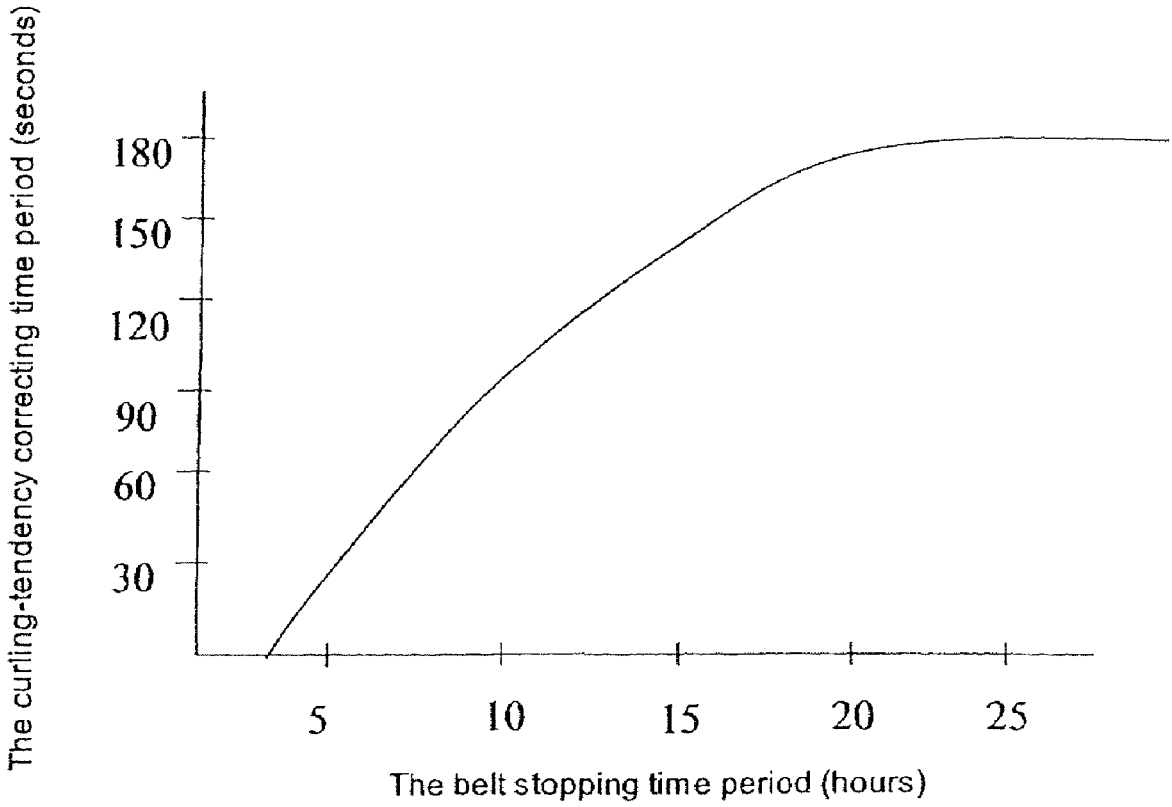
FIG. 3 is an explanation view of driving and controlling of the endless belt.

With reference to FIGS. 1 to 3, there will be described an image forming apparatus according to a first embodiment of the present invention. FIG. 1 is a schematic explanation view of the entire image forming apparatus. FIG. 2 is an explanation view of winding and stringing of an endless belt. FIG. 3 is an explanation view of driving and controlling of the endless belt.

{The Configuration of the Entire Image Forming Apparatus}

First, with reference to FIG. 1, the entire configuration of the image forming apparatus will be briefly described, along with operations for forming an image. The image forming apparatus according to the present embodiment forms color images, according to an electrophotographic type.

An image forming means includes four image forming stations which are placed substantially horizontally, wherein the image forming stations which form toner images in respective colors of yellow Y, magenta M, cyan C and black K are placed in the mentioned order from the left-hand side of FIG. 1. The image forming stations have the same configuration, except that they have different toner colors.

In each image forming station, there are placed a primary charger 2, a development device 3 and a cleaning device 4, around a photosensitive drum 1. Further, above the aforementioned photosensitive drum 1, there is placed a scanner unit 5 which directs, thereto, laser light according to image signals.

Further, an intermediate transfer belt 6 which is an endless belt is rotatably provided such that it is kept in contact with the aforementioned photosensitive drum 1. Further, a primary transfer roller 7 is provided at a position which faces to the photosensitive drum 1 across the intermediate transfer belt 6.

During image formation, the primary charger 2 uniformly charges the surface of the photosensitive drum 1 while the photosensitive drum 1 is rotated in the counter clockwise direction, the scanner unit 5 directs, thereto, laser light according to image signals to form an electrostatic latent image thereon, and the development device 3 develops the latent image with the toner to form a visible image.

The aforementioned toner image is primarily transferred to the intermediate transfer belt 6 through the application of a bias to the primary transfer roller 7. Further, the toners having the respective colors of yellow, magenta, cyan and black which have been created in the respective image forming stations are superimposed on and transferred to the intermediate transfer belt 6 to form a color image. At a secondary transfer portion which is an image recording portion, through the application of a bias to a secondary transfer roller 8, the color image is secondarily transferred to a recording medium P conveyed thereto by a recording-medium conveyance means, not illustrated, to complete recording of the image.

Then, the recording medium having the toner images transferred thereto is directed to a fixing device 9. The fixing device 9 applies heat and a pressure thereto to fix the toner images on the sheet P (the recording material) and, then, the recording medium is ejected to the outside of the apparatus.

{The Configuration for Eliminating the Curling Tendency of the Intermediate Transfer Belt}

The image forming apparatus according to the present embodiment is provided with a deformation correction means for eliminating the curling tendency of the aforementioned intermediate transfer belt 6. The configuration thereof will be described hereinafter.

It is preferable that the intermediate transfer belt 6 for use in the present embodiment has a volume resistivity in the range of $10^6$ to $10^{12}$ Ω·cm. The material of the intermediate transfer belt 6 can be an urethane-based resin, a fluororesin, a nylon-based resin, a polyimide resin or an elastic material such as a silicon rubber, an hydrin rubber. Also, it is possible to disperse carbon or an electrically-conductive material in the aforementioned materials for adjusting their resistances. The intermediate transfer belt 6 for use in the present example is formed by shaping a polyimide to have a thickness of 100 μm, a width of 350 mm and a circumferential length of 2500 mm.

As illustrated in FIG. 2, the aforementioned transfer belt 6 is wound and stringed around three tension rollers (first rollers) which support the inner side of the endless belt, wherein the three tension rollers are a driving roller 10, a separation roller 11 and a supporting roller 12. Further, a belt counter warping roller (a second roller) 13 is placed at a predetermined position, wherein the belt counter warping roller 13 forms a counter warping means placed at the outer side of the aforementioned intermediate transfer belt 6. The belt counter warping roller 13 applies a pressure to the intermediate transfer belt 6 to apply a tension to the intermediate transfer belt 6, such that the intermediate transfer belt 6 is curved in the inward direction that is opposite from the direction of warpage of the belt wound around the aforementioned three tension rollers 10, 11 and 12.

In this case, the driving roller 10 is a roller including a rubber layer at its surface and having a diameter of 20 mm. The separation roller 11 and the supporting roller 12 are metal rollers. Both the separation roller 11 and the supporting roller 12 have a diameter of 20 mm. The counter warping roller 13 is a metal roller having a diameter of 18 mm.

It is desirable to set the tension applied to the intermediate transfer belt 6, such that the elongation percentage is equal to or less than 1%, depending on the material of the intermediate transfer belt 6, in order to prevent the occurrence of ruptures and permanent sets in the intermediate transfer belt 6. In the present embodiment, a polyimide-resin based intermediate transfer belt 6 is employed and the apparatus is set to apply a force of 15 kgf thereto.

The intermediate transfer belt 6 is rotated by the driving roller 10. Further, the driving roller 10 is rotated by a motor 14 which is a driving means.

In the image forming apparatus according to the present embodiment, a speed changing device (a speed changing means) 15 changes the rotation speed of the motor, which enables changing the rotation speed of the intermediate transfer belt 6 in three steps. A speed changing means rotates the intermediate transfer belt 6 at a first speed and rotates the intermediate transfer belt 6 at a second speed smaller than said first speed or stops the intermediate transfer belt 6, prior to image formation after the stoppage of the belt, wherein said speed changing means rotates the intermediate transfer belt 6 at a second speed or stops the intermediate transfer belt 6 when the portion of the intermediate transfer belt 6 which has been supported by said first roller at the time of stoppage of the intermediate transfer belt 6 are supported by said second roller.

Namely, the rotation speed of the intermediate transfer belt 6 can be switched among a speed A (a first speed) (100 mm/sec) for use in forming an image on plain paper, a speed C (50 mm/sec) for use in forming an image on thick paper and a speed B (a second speed) (10 mm/sec) smaller than the speed A. In this case, the speed C is smaller than the speed B which is the smallest speed for use in image formation.

Further, in rotating the intermediate transfer belt 6 at the speed A prior to image formation, the speed of the intermediate transfer belt 6 is set to the speed B which is smaller than the speed A, when the portions of the belt which have been wound around the aforementioned rollers 10, 11 and 12 during the stoppage of the belt pass around the counter warping roller 14.

During stoppage of the belt at a non-operation state of the image forming apparatus (for example, a power-off state at night, a standby state) and the like, bending stresses and physical changes are generated in the intermediate transfer belt 6 concentratively at its portions wound around the tension rollers 10, 11 and 12. This may cause these portions of the intermediate transfer belt 6 to exhibit a curling tendency. Further, such a curling tendency may cause degradation of images.

Therefore, in the present embodiment, in order to correct the curling tendency of the intermediate transfer belt 6 prior to image formation, the belt is rotated. The correction of the curling tendency is performed, when the non-operation state of the image forming apparatus is cancelled, such as when the image forming apparatus is powered up, after a standby state and the like.

More specifically, as illustrated in FIG. 2, the intermediate transfer belt 6 is idly rotated at the speed A (100 mm/sec), until the portion α of the belt which has existed around the driving roller 10 at the time of stoppage of the belt and thus has a curling tendency (hereinafter, referred to as a curling-tendency portion α) reaches the counter warping roller 13. Then, the intermediate transfer belt 6 is driven at the speed B (10 mm/sec) smaller than the speed A, only during the time period in which the curling-tendency portion α exists within the interval (a-b) stringed around the counter warping roller 3. In this case, the counter warping roller 13 applies a stress to the curling-tendency portion α in the opposite direction to correct the curling tendency. After the curling-tendency generated portion α passes the interval (a-b) stringed around the counter warping roller 13, the driving speed of the intermediate transfer belt 6 is restored to the speed A. Consequently, the correction of the curling tendency at the curling-tendency portion α has been completed.

Subsequently, the intermediate transfer belt 6 is driven at the speed B (10 mm/sec), only during the time period in which the portion β of the belt that has existed around the separation belt 11 at the time of stoppage of the belt and thus has a curling tendency (hereinafter, referred to as a curling-tendency portion β) exists within the interval (a-b) stringed around the counter warping roller 13.

Similarly, a curling-tendency portion γ which has existed around the supporting roller 12 at the time of stoppage of the belt when the apparatus is not operated (hereinafter, referred to as a curling-tendency portion γ) is passed around the counter bending roller 13 at the lower speed to correct the curling tendency.

The aforementioned operations are repeated during the rotation of the intermediate transfer belt 6. Further, the time period in which the intermediate transfer belt 6 is rotated prior to image formation is properly set depending on the material of the belt and the state of the curling tendency.

The timing when the curling-tendency portions α, β and γ pass the interval (a-b) around the counter warping roller 13 as described above can be determined from the time period elapsed since the start of driving of the belt and the distances from the counter warping roller 13 to the rollers 10, 11 and 12 along the belt circumference.

As described above, the belt is rotated slowly only during the time period in which the curling-tendency portions α, β and γ come into contact with the counter warping roller 13 to elongate the curling-tendency correcting time period.

FIG. 3 illustrates the results of experiments conducted for determining the time period required for correcting the curling tendency as aforementioned by rotating the intermediate transfer belt 6 prior to image formation. The experiments were conducted for the following cases.

(1) The rotation speed of the intermediate transfer belt 6 was kept constant at the speed A (100 mm/sec).

(2) The rotation speed of the intermediate transfer belt 6 was switched to the speed B (10 mm/sec) when the curling-tendency portions α, β and γ passed around the counter warping roller 13.

Further, for comparison, the same experiments were conducted for the case where (3) the speed B was set to 20 mm/sec when the curling-tendency portions passed around the counter warping roller 13. Further, in FIG. 3, round marks indicate states where the curling tendency had been sufficiently corrected, while cross marks indicate states where the curling tendency had been insufficiently corrected.

As can be clearly seen from FIG. 3, by reducing the rotation speed to the speed B when the curling-tendency potions α, β and γ pass the interval around the counter warping roller 13 as in the present embodiment, the curling-tendency correcting time period can be reduced to about 1/10 of that of the case of rotating the belt without reducing the speed.

This is because the ratio of the time period in which the curling-tendency portions α, β and γ are wound around the counter warping roller 13 with respect to the rotating time period for correction is increased, since the speed of the intermediate transfer belt 6 is reduced only during the time period in which the curling-tendency portions α, β and γ pass around the counter warping roller 13 as in the present embodiment.

Further, it is effective to set the speed B to 20 mm/sec, but it is possible to set the speed B to 10 mm/sec for reducing the curling-tendency correcting time period.

By repeating the aforementioned controlling at a desired rotation speed, it is possible to efficiently correct the curling tendency.

Second Embodiment

While, in the aforementioned embodiment, there has been exemplified a case where the belt rotation speed is reduced when the curling-tendency portions α, β and γ of the intermediate transfer belt 6 pass around the counter warping roller 13, it is also possible to drive and control the belt in such a way as to temporarily stop the driving of the belt. For example, the intermediate transfer belt 6 can be stopped for 1 second, when the curling-tendency portions α, β and γ of the intermediate transfer belt 6 pass around the counter warping roller 13.

With the aforementioned driving and controlling, it is possible to offer effects equivalent to those offered by speed reduction. However, in this case, it is necessary that the curling-tendency portions α, β and γ be wound around the counter warping roller 13 without being protruding therefrom at the time of stoppage of the belt and, therefore, the apparatus is configured such that the amount of winding of the belt around the counter warping roller 13 is greater than those around the other rollers which support the belt. In this case, "the amount of winding" refers to the length of the portion of the intermediate transfer belt which is supported by the driving roller 10, the separation roller 11, the supporting roller 12 or the counter warping roller 13, in the direction of the rotation of the intermediate transfer belt 6.

Therefore, in the present example, the diameters of the driving roller 10, the separation roller 11 and the supporting roller 12 are all set to 20 mm, similarly to those in the image forming apparatus according to the first embodiment. Further, the diameter of the counter warping roller 11 is set to 24 mm.

Third Embodiment

Figure 4:
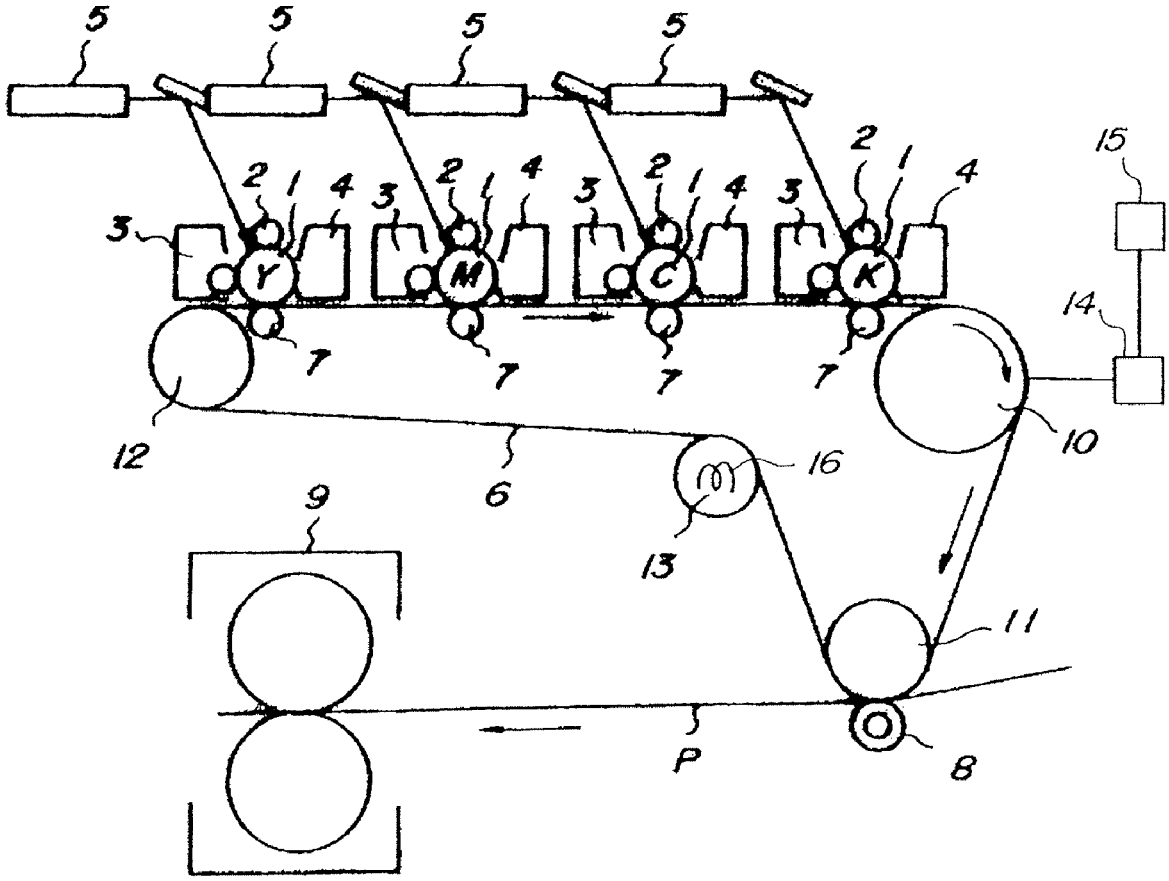
FIG. 4 is a schematic view of the entirety of an image forming apparatus which includes a counter warping roller provided with a heater.

FIG. 4 illustrates an image forming apparatus which employs, as a counter warping roller 13, a metal roller internally including a heater 16 which is a heating means. In the present example, a ceramic heater is employed as the heater 16. The image forming apparatus according to the present example has the same configuration as that of the image forming apparatus according to the first embodiment except the counter warping roller 13. Therefore, the components which have the same configurations and effects will be designated by the same reference characters and description thereof will be omitted.

In the present example, the counter warping roller 13 is heated to 50 degree. C by the heater 16, when the curling-tendency portions pass around the counter warping roller 13 or when the intermediate transfer belt 6 is stopped at states where the curling-tendency portions are wound around the counter warping roller 13. The counter warping roller 13 heats the curling-tendency portions of the intermediate transfer belt 6 to effectively correct the curling-tendency portions.

Fourth Embodiment

Figure 5:
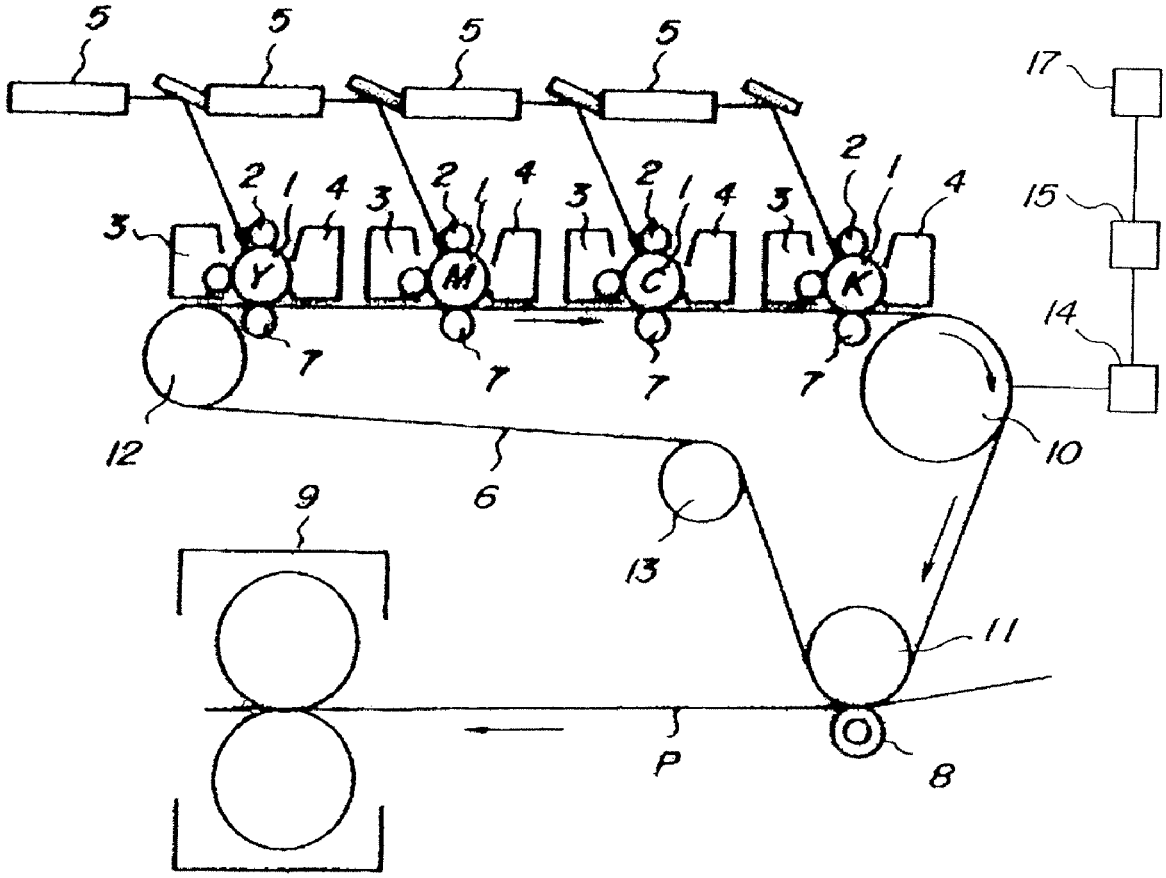
FIG. 5 is a schematic view of the entirety of an image forming apparatus which includes a timer for measuring the belt stopping time period.

Also, it is possible to control the speed of the intermediate transfer belt 6, according to the belt stopping time period during the standby time period of the apparatus main body, the power-off time period of the apparatus main body and the like. FIG. 5 illustrates an image forming apparatus according to the present embodiment. In the present example, there is provided a timer 17 for measuring the belt stopping time period. Further, the image forming apparatus according to the present embodiment has the same configuration as that of the image forming apparatus according to the first embodiment except the timer 17. Therefore, the components which have the same configurations and effects will be designated by the same reference characters and description thereof will not be repeated.

FIG. 6 illustrates the relationship between the stopping time period of the intermediate transfer belt 6 and the rotating time period of the intermediate transfer belt 6 which is required for correcting the intermediate transfer belt 6 (hereinafter, referred to as a "curling-tendency correcting time period"). The curling-tendency correcting time period in FIG. 4 is the time period required when the aforementioned speed B is set to 10 mm/sec. As can be seen from FIG. 6, as the belt stopping time period is increased, the curling tendency is left more significantly and, therefore, the curling-tendency correcting time period should be increased. In the present example, as in FIG. 6, the curling-tendency correcting time period is changed according to the belt stopping time period during the standby time period, the power-off time period of the main body and the like.

Namely, when the belt stopping time period is less than 2.5 hours, the curling-tendency correcting time period is set to be substantially zero.

When the belt stopping time period is equal to or greater than 2.5 hours, but less than 5 hours, the curling-tendency correcting time period is set to 30 seconds.

When the belt stopping time period is equal to or greater than 5 hours, but less than 10 hours, the curling-tendency correcting time period is set to 90 seconds.

When the belt stopping time period is equal to or greater than 10 hours, but less than 15 hours, the curling-tendency correcting time period is set to 120 seconds.

When the belt stopping time period is equal to or greater than 15 hours, the curling-tendency correcting time period is set to 180 seconds.

As described above, the curling-tendency correcting time period is increased with increasing belt stopping time period.

Further, as illustrated in FIG. 5, the apparatus is configured to change the curling-tendency correcting time period, namely the rotating operation time period in which the belt is driven and controlled such that it is slowed or stopped when curling-tendency portions pass around the counter warping roller 13, depending on the belt stopping time period. Further, FIG. 7 illustrates the mode of changing the belt speed during the curling-tendency correcting time period and the result of the correction of the curling tendency in the case where the belt stopping time period was equal to or greater than 2.5 hours, but less than 5 hours, wherein round marks indicate that the correction of the curling tendency was sufficiently completed,. while cross marks indicate that the correction of the curling tendency was insufficiently completed.

By increasing the rotating time period for the curling-tendency correction with increasing belt stopping time period as described above, it is always possible to offer preferable effects regardless of the length of the belt stopping time period. Further, it is possible to prevent the curling-tendency correcting time period from being increased vainly.

Other Embodiments

In the aforementioned embodiments, there have been exemplified intermediate transfer type image forming apparatuses which employ an intermediate transfer belt as an endless belt. However, the present invention can be applied to an image forming apparatus which conveys a recording medium through an endless belt facing to respective image forming stations and successively transfers color images formed in the respective image forming stations to the recording medium such that they are superimposed thereon to form a color image.

Further, the endless belt may be a belt other than an intermediate belt and a recording-medium conveyance belt as aforementioned. For example, the present invention can be applied to an image forming endless belt such as a photosensitive member belt for use in forming electrostatic latent images, a fixing belt for use in thermally fixing toner images on a recording medium and the like.

This application claims the benefit of priority from the prior Japanese Patent Application No. 2005-346307 filed on Nov. 30, 2005 the entire contents of which are incorporated by reference herein.

What is claimed is:

1. An image forming apparatus comprising:

a belt;

a first roller which supports said belt;

a second roller which supports said belt at a belt surface opposite from a belt surface supported by said first roller; and speed changing means performing a function when said belt starts to rotate for:

rotating said belt at a first speed when a first belt portion, which was contacted with said first roller at a time of belt stoppage, contacts with said second roller, and rotating said belt at a second speed, which is greater than said first speed, when a second belt portion, which was not contacted with said first roller at the time of belt stoppage contacts with said second roller.

2. The image forming apparatus according to claim 1, wherein the second speed is a rotation speed of said belt when images are formed.

3. The image forming apparatus according to claim 1, wherein said speed changing means performs the function before forming images.

4. The image forming apparatus according to claim 1, wherein said second roller includes a heater.

5. The image forming apparatus according to claim 4, wherein said second roller is heated by said heater when the first belt portion contacts with said second roller.

6. The image forming apparatus according to claim 1, wherein said speed changing means lengthens an operating time of the function when the time of belt stoppage, before starting rotation of said belt, is of a long duration.

7. The image forming apparatus according to claim 1, wherein said belt is an intermediate transfer belt for bearing toner images.

8. The image forming apparatus according to claim 1, wherein said belt is a recording-medium conveyance belt for conveying a recording-medium.

9. An image forming apparatus comprising:

a belt;

a first roller which supports said belt; and a second roller which supports said belt at a belt surface opposite from a belt surface supported by said first roller;

wherein an amount of curling when said belt twines around said second roller is larger than an amount of curling when said belt twines around said first roller, wherein the image forming apparatus has a function for:

controlling a driving of said belt as a first belt portion, which has contacted with said first roller at a time of belt stoppage, is moving to a contacting portion, at which said second roller contacts with said belt, and stopping said belt when the first belt portion is moved to the contacting portion.

10. The image forming apparatus according to claim 9, wherein the image forming apparatus includes an other roller supporting said belt, wherein the amount of curling when said belt twines around said second roller is larger than an amount of curling when said belt twines around said other roller.

11. The image forming apparatus according to claim 9, wherein said second roller includes a heater.

12. The image forming apparatus according to claim 11, wherein said second roller is heated by said heater when the first belt portion contacts with said second roller.

13. The image forming apparatus according to claim 9, wherein operating time of the function is lengthened when the time of belt stoppage, before starting of rotation of said belt, is of a long duration.

14. The image forming apparatus according to claim 9, wherein said belt is an intermediate transfer belt for bearing toner images.

15. The image forming apparatus according to claim 9, wherein said belt is a recording-medium conveyance belt for conveying a recording-medium.

* * * * *